United States Patent [19]

Pabst et al.

[11] Patent Number: 4,693,013

[45] Date of Patent: Sep. 15, 1987

[54] INFRARED DRYER

[75] Inventors: Manfred Pabst, Cologne; Peter Mevissen, Erkelenz, both of Fed. Rep. of Germany

[73] Assignee: A. Monforts GmbH & Co., Moenchengladbach, Fed. Rep. of Germany

[21] Appl. No.: 876,379

[22] Filed: Jun. 19, 1986

[30] Foreign Application Priority Data

Jun. 25, 1985 [DE] Fed. Rep. of Germany ..... 3522695

[51] Int. Cl.[4] ..... F26B 3/30

[52] U.S. Cl. ..... 34/4; 34/41; 250/504 R; 250/453.1

[58] Field of Search ..... 250/504 R, 492.1, 453.1, 250/454.1, 455.1; 34/4, 41, 49, 48

[56] References Cited

U.S. PATENT DOCUMENTS 4,005,135 1/1977 Helding ..... 34/4

4,220,865 9/1980 Silverman ..... 34/4

FOREIGN PATENT DOCUMENTS

522990/82a.34 12/1954 Fed. Rep. of Germany .

*Primary Examiner*—Larry I. Schwartz

*Attorney, Agent, or Firm*—Herbert L. Lerner; Laurence A. Greenberg

[57] ABSTRACT

An infrared dryer includes an operating duct being at least as wide as a spread out textile fabric web passing through the duct for treatment, outer ducts disposed outside the operating duct, heating walls formed of adjacent wall elements substantially parallel to the surface of the fabric web separating said operating duct from the outer ducts, infrared radiators disposed on the wall elements, pivot axes about which the wall elements are pivotable through substantially 180° for moving the infrared radiators between the operating duct and the outer ducts, an air suction device, and a device for directing air into the air suction device from any of the ducts containing the infrared radiators at a given moment.

5 Claims, 2 Drawing Figures

INFRARED DRYER

Figure 1:
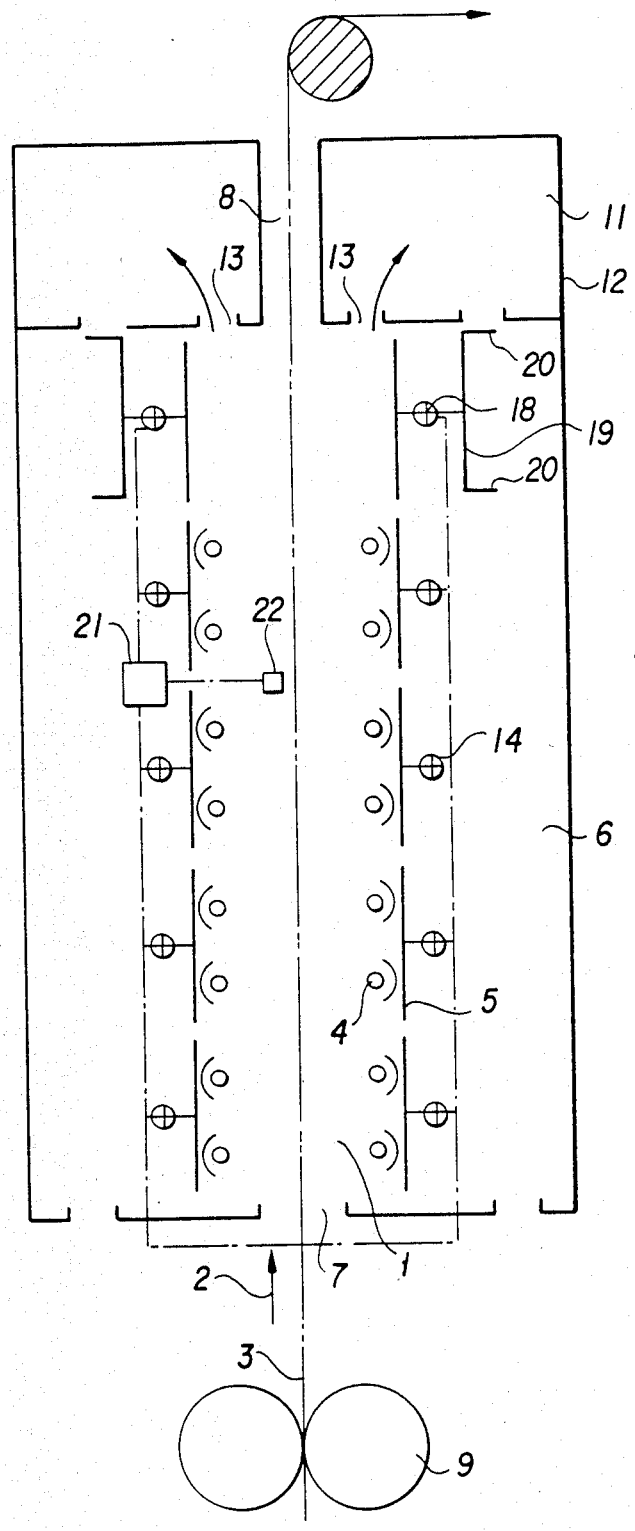

The invention relates to an infrared dryer (IR dryer), including an operating duct through which a spread out textile fabric web vertically passes, the operating duct being at least as wide as the fabric web to be treated, infrared radiators disposed individually or in groups at heating walls extending parallel to the surface of the web, the infrared radiators (IR radiators) being pivotable through 180° about a horizontal axis, and the duct being provided with a suction device in the vertical direction of the duct. The infrared radiators are conventionally heated electrically or by gas. The IR dryers are also known as IR-channels or canals.

If the textile web comes to a stop in the operating duct of an IR dryer in which the web is generally conducted vertically from the bottom upward, the goods which are introduced in a wet condition are quickly dried and the danger of over drying or burning the goods exists. In order to prevent this, metal shields are moved in front of the IR radiators and the radiators themselves are turned off. However, the protective shields are still heated so much that their shape and therefore their mobility deteriorates in the long run. Therefore, it has been suggested to introduce air or steam until the radiators have cooled, if the fabric web has stopped and the radiators have been turned off. According to another method, water is sprayed onto the goods until the radiators have cooled or the machine has started up again. Disregarding the still existing dangers of excessive drying or fire, an important disadvantage of the conventional methods is that the radiators have to be turned off and the radiators do not radiate at the correct temperature when the goods start to move again.

In German Patent Application S 22 990/82a.34 published on Dec. 30, 1954, an infrared radiation device is described, wherein the radiators can be moved between two end positions, so that in the waiting position, which is different from the operating position, the emitted radiation is directed away from the goods, in order to prevent scorching of the goods to be treated. Depending on the position of the radiators in the waiting position with the heating energy turned on, the adjacent radiator or the parts surrounding the machine are excessively heated.

Although there is no danger of the motionless fabric web becoming damaged, it is necessary to turn off the radiators in order to prevent damage to the machine or its surroundings.

It is accordingly an object of the invention to provide an infrared dryer, which overcomes the hereinaforementioned disadvantages of the heretofore-known devices of this general type and which has radiators that can be pivoted out of the operating duct, in such a way that the IR radiators are energized with full power even in the pivoted-out waiting condition and therefore when they are turned back and the machine is started again, the radiators are available at the temperature required for proper operation.

With the foregoing and other objects in view there is provided, in accordance with the invention, an infrared dryer, comprising an operating duct being at least as wide as a spread out textile fabric web vertically passing through the duct for treatment, outer ducts disposed outside the operating duct, heating walls formed of adjacent wall elements substantially parallel to the surface of the fabric web separating the operating duct from the outer ducts, infrared radiators disposed individually or in groups on the wall elements, horizontal pivot axes about which the wall elements are pivotable through substantially 180° for moving the infrared radiators between the operating duct and the outer ducts, an air suction device in the operating duct in a vertical direction, and means for directing or shifting air into the air suction device from any of the ducts containing the infrared radiators at a given moment.

In accordance with another feature of the invention, there are provided means for pivoting the wall elements about the axes, the pivoting means being coupled to the directing means.

In accordance with a concomitant feature of the invention, there are provided means for pivoting the wall elements, so that the infrared radiators are out of the operating duct when the fabric web stops moving and for pivoting the wall elements so that the infrared radiators are in the operating duct when the fabric web starts moving again.

The invention achieves the advantage of preventing overheating or burning of the goods during a standstill of the web, due to the feature that the IR radiators move out of the operating duct and that the IR radiators which have swung to the outer duct which border on the operating duct, can continue under full power, because they are cooled due to the shifting of the air suction device and flue gases in the operating duct are sucked off as in conventional installations, when using gasheated radiators.

Other features which are considered as characteristic for the invention are set forth in the appended claims.

Although the invention is illustrated and described herein as embodied in an infrared dryer, it is nevertheless not intended to be limited to the details shown, since various modifications and structural changes may be made therein without departing from the spirit of the invention and within the scope and range of equivalents of the claims.

Figure 2:
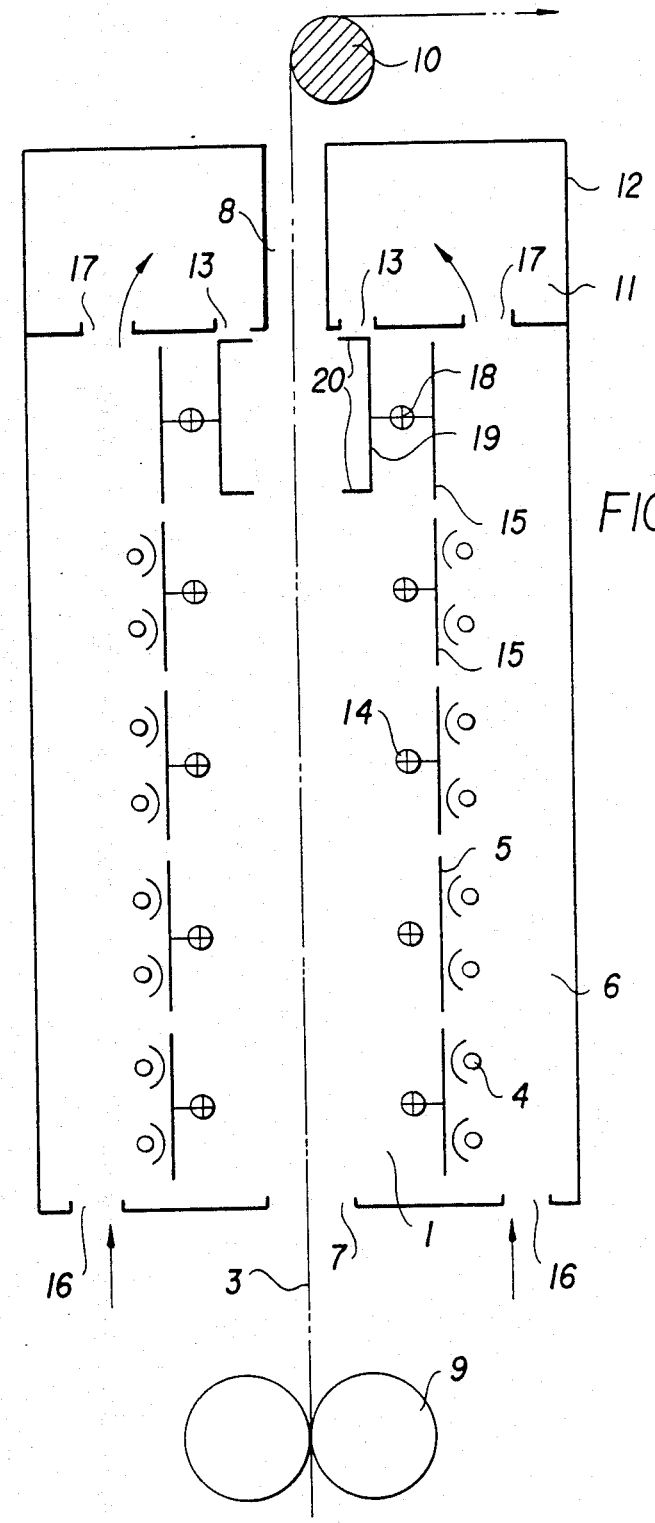

The construction and method of operation of the invention, however, together with additional objects and advantages thereof will be best understood from the following description of specific embodiments when read in connection with the accompanying drawings, in which:

FIG. 1 is a diagrammatic, vertical-sectional view of an IR dryer with IR radiators directed toward a fabric web: and FIG. 2 is a view similar to FIG. 1 of an IR dryer with IR radiators swung out of the operating tunnel or duct.

Referring now to FIGS. 1 and 2 in detail, it is seen that the IR dryer is essentially formed of an operating duct or tunnel 1 through which a spread out textile web 3 is conducted in a vertical transport direction 2 between heating walls 5 which are equipped with IR radiators 4, as well as respective outer ducts 6 adjacent the heating wall surfaces. The operating duct 1 is at least as wide as the web 3 which is to be treated (measured perpendicular to the plane of the drawing). The distance between the IR radiators 4 and the fabric web, the power of the IR radiators 4 and the transport speed in the direction 2, are adjusted with respect to each other in such a way that a fabric web 3 which is introduced into an inlet 7 at the lower end of the duct 1 in the wet condition, arrives at an outlet 8 in a condition which is required for additional treatment, such as treatment in a tenter or stretchig frame. The fabric web 3 can be conducted to the inlet 7 of the operating duct from a squeezer 9, for example. From the outlet 8, the web 3 can be conducted over a guide roller 10 for further transport.

In some cases considerable amounts of steam, evaporated textile treatment agents and flue gases, when using gas heaters, are set free during treatment in the operating duct 1. These waste gases are sucked off during the operation by a suction device 11, which is disposed at the upper ends of the operating duct 1 and the outer ducts 6. The pipelines and fans provided for the suction operation are not the subject of the invention and for this reason are not shown in the drawing, in order to simplify the presentation. The suction device 11 is formed of two suction boxes 12, which are disposed to the right and to the left of the fabric web 3 and of the outlet 8 of the duct 1. For this reason, each suction box is provided with a suction slot 13 for each half of the working duct defined by the surface of the fabric web 3. The waste gases generated during the operation of the duct 1 are sucked off through the suction slots 13. Therefore air is sucked in through the inlet 7 at the lower end of the operating duct 1.

In the IR dryer according to FIGS. 1 and 2, the heating walls, which as a whole are designated with reference numeral 5, contain pivotable wall elements 15 which can pivot about axes 14. The IR radiators 4 are fastened to the wall elements. By rotating the wall elements through 180° about the axes 14, the IR radiators radiate into the outer duct 6 which is adjacent to the surface of the heating wall 5, instead of into the operating or main duct 1.

In the condition according to FIG. 1 the IR radiators 4 are directed toward the web 3 which moves in the transport direction 2. In contrast thereto, FIG. 2 shows the condition of the IR dryer in which the IR radiators 4 together with the adjacent wall elements 15 are rotated about the respective pivot axes 14 toward the outside and are directed into the outer duct 6. In the FIG. 2 condition, the operation of the suction device 11 is also shifted from the suction slots 13 of the operating duct 1 to suction slots of the outer ducts 6. The outer ducts 6 have air inlets 16 at the lower end of the dryer and suction slots 17 at the upper end of the dryer in the vicinity of the suction device 11. The shifting may also be effected by closing the suction slots 13 of the operating duct 1 and the suction slots 17 of the outer ducts 6. For this purpose a pivotable flap 19 may be provided for each suction box 12, which pivots about an axis 18, which is parallel to the axes 14, simultaneously with the pivoting of the wall elements 15. In the illustrated embodiment, the flap or door 19 can be formed of a wall element which is similar to the wall elements 15 and has a U-shaped closure part 20. The closure parts 20 are constructed and disposed in such a way that they alternatingly cover either the suction slot 17 of the outer duct 6 or one of the suction slots 13 of the operating duct, when pivoting the flap 19 about the axis 18. As the drawing clearly shows, the construction of the flap 19, which is similar to the construction of the wall elements 15 which carry the IR radiators 4, has the advantage of permitting the flaps 19 to be moved with the same drive mechanism as that used for the wall elements 15. These common pivoting means are represented by the common axis 18 and the axes or shafts 14, 18 can be controlled by a common drive 21. Furthermore, a sensor 22, such as an opto-electric sensor, senses when the web 3 has stopped moving and causes the drive 21 to pivot the wall elements 15 so that the radiators 4 are out of the duct 1. The radiators are moved into the duct 1 when the web starts moving again.

We claim:

1. Infrared dryer, comprising an operating duct being at least as wide as a spread out textile fabric web passing through said duct for treatment, outer ducts disposed outside said operating duct, heating walls formed of adjacent wall elements substantially parallel to the surface of the fabric web separating said operating duct from said outer ducts, infrared radiators disposed on said wall elements, pivot axes about which said wall elements are pivotable through substantially 180° for moving said infrared radiators between said operating duct and said outer ducts, an air suction device, and means for directing air into said air suction device from any of said ducts containing said infrared radiators at a given moment.

2. Infrared dryer according to claim 1, including means for pivoting said wall elements about said axes, said pivoting means being coupled to said directing means.

3. Infrared dryer according to claim 1, including means for pivoting said wall elements so that said infrared radiators are out of said operating duct when the fabric web stops moving and for pivoting said wall elements so that said infrared radiators are in said operating duct when the fabric web starts moving again.

4. Infrared dryer according to claim 2, including means for pivoting said wall elements so that said infrared radiators are out of said operating duct when the fabric web stops moving and for pivoting said wall elements so that said infrared radiators are in said operating duct when the fabric web starts moving again.

5. Infrared dryer according to claim 1, including means for maintaining said radiators at full power while facing into said operating duct and into said outer ducts.

* * * * *